US007298340B2

(12) United States Patent
Ohba

(10) Patent No.: US 7,298,340 B2
(45) Date of Patent: Nov. 20, 2007

(54) ANTENNA DEVICE AND RADIO APPARATUS CAPABLE OF MULTIBAND OPERATION

(75) Inventor: Isao Ohba, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/499,558

(22) Filed: Aug. 4, 2006

(65) Prior Publication Data

US 2007/0035458 A1 Feb. 15, 2007

(30) Foreign Application Priority Data

Aug. 9, 2005 (JP) ..... 2005-230298

(51) Int. Cl.
*H01Q 1/24* (2006.01)

(52) U.S. Cl. ..... 343/702; 343/700 MS

(58) Field of Classification Search ..... 343/702, 343/700 MS, 876

See application file for complete search history.

(56) References Cited

U.S. PATENT DOCUMENTS

| | | | | |
|---|---|---|---|---|
| 2004/0246179 | A1* | 12/2004 | Chen et al. | 343/700 MS |
| 2006/0050007 | A1* | 3/2006 | Min | 343/876 |
| 2006/0152419 | A1* | 7/2006 | Sato et al. | 343/702 |
| 2006/0262015 | A1* | 11/2006 | Thornell-Pers et al. | 343/702 |

FOREIGN PATENT DOCUMENTS

| | | |
|---|---|---|
| JP | 2001-136019 A | 5/2001 |
| JP | 2003-46318 A | 2/2003 |
| JP | 2004-40596 A | 2/2004 |

OTHER PUBLICATIONS

Sekine, S. and Shoki, H., "Characteristics of T-type Monopole Antenna with Parallel Resonance Mode", IEICEJ, Trans. vol. J86-B, No. 2, pp. 200-208, Feb. 2003 (in Japanese).

* cited by examiner

*Primary Examiner*—Hoang V. Nguyen
(74) *Attorney, Agent, or Firm*—Frishauf, Holtz, Goodman & Chick, P.C.

(57) ABSTRACT

An antenna device and a radio apparatus are provided. The antenna device is configured to be coupled to a feeding point of the radio apparatus. The antenna device has a first antenna element and a second antenna element. The first antenna element is configured to be an unbalanced-fed antenna fed at the feeding point to resonate at a first frequency. The second antenna element is configured to be a monopole antenna having an open end and to be fed at the feeding point. The first antenna element and the second antenna element have a common portion from the feeding point to a branching point. The second antenna element is configured to be ungrounded in a first state to resonate at a second frequency lower than the first frequency and to be grounded in a second state at a switch point between the branching point and the open end.

12 Claims, 12 Drawing Sheets

ANTENNA DEVICE AND RADIO APPARATUS CAPABLE OF MULTIBAND OPERATION

CROSS REFERENCE TO RELATED APPLICATIONS

This application is based upon and claims the benefit of priority from the prior Japanese Patent Application No. 2005-230298 filed on Aug. 9, 2006; the entire contents of which are incorporated herein by reference.

FIELD OF THE INVENTION

The present invention relates to an antenna device and a radio communication apparatus capable of multiband operation, and in particular to those adapted for mobile use.

DESCRIPTION OF THE BACKGROUND

As radio apparatus like mobile phones, etc. come into wide use and have a wider range of application, antennas having a broader frequency range are required more than ever for radio apparatus. For instance, it is thought that an ultra-high frequency (UHF) band as broad as a couple of hundred megahertz (MHz) is required for receiving terrestrial digital television broadcast. In order that a radio apparatus using a single antenna for downsizing is adapted for two or more standards of wireless local area networks (WLAN) of different frequencies, the antenna has to cover both 2.4 gigahertz (GHz) and 5.2 GHz bands.

A multi-resonant antenna applicable to WLANs is disclosed in Japanese Patent Publication (Kokai), No. 2003-46318. The multi-resonant antenna includes an antenna element formed by a linear or band-shaped conductor one end of which is fed at a feeding point on and surrounded by a ground plane and another end of which is grounded on the ground plane. The antenna element is loaded with an impedance element so that the multi-resonant antenna resonates at a frequency determined by a length of the linear or band-shaped conductor and resonates at another frequency determined by a value of the impedance element.

An antenna including an antenna element formed by a linear or plate-shaped conductor loaded with a reactance element for multi-resonance is disclosed in Japanese Patent Publication (Kokai), No.2004-40596, and is called here a reactance-loaded antenna. The antenna element of the reactance-loaded antenna is divided by the reactance element by a ratio that determines a resonant frequency of the reactance-loaded antenna.

A majority of radio apparatus adopt built-in antennas these days. In order to select a type of built-in antennas, it is necessary to examine candidates of built-in antennas from viewpoints of size, inefficiency of radiation caused by return currents, necessity of balance-to-unbalance transformation, etc.

As one of the candidates that may somehow satisfy the necessity from the above viewpoints, known is a half-wavelength T-type monopole antenna. One example of that type of antenna is disclosed in:

Sekine, S. and Shoki, H., "Characteristics of T-type monopole antenna with parallel resonance mode", IEICEJ. Trans. Vol. J86-B, No. 2, pp. 200-208, February 2003 (in Japanese).

The above example of the T-type monopole antenna is configured that lengths of a left half and a right half thereof are unequal so that the antenna may be resonant in a parallel resonance mode and may cope with both downsizing and efficiency of radiation by increasing input impedance.

The multi-resonant antenna or the reactance-loaded antenna described above may be multi-resonant by being loaded with a reactance element located at a middle portion of the antenna element, i.e., somewhere between both ends of the antenna element. In a case where a resonant frequency needs to be changed or tuned, however, a value of the reactance has to be adjusted. Hence, there is a problem that the above antennas may not be suitable for an application that needs a significant change of the resonant frequency, e.g., WLANs.

The parallel resonance mode of the T-type monopole antenna described above may be effective depending on a configuration of radio apparatus. The T-type monopole antenna, however, may not be suitable for a radio apparatus a feeder system of which is designed to match the input impedance of the antenna at a series resonant frequency of the antenna, as the increase of the input impedance in the parallel resonant mode is likely to cause a mismatch.

SUMMARY OF THE INVENTION

Accordingly, an advantage of the present invention is that a resonant frequency of an antenna device may be significantly changed while causing little mismatch of the antenna's input impedance.

To achieve the above advantage, one aspect of the present invention is to provide an antenna device and a radio apparatus capable of multiband operation. The antenna device is configured to be coupled to a feeding point of the radio apparatus. The antenna device has a first antenna element and a second antenna element. The first antenna element is configured to be an unbalanced-fed antenna fed at the feeding point to resonate at a first frequency. The second antenna element is configured to be a monopole antenna having an open end and to be fed at the feeding point. The first antenna element and the second antenna element have a common portion from the feeding point to a branching point. The second antenna element is configured to be ungrounded in a first state to resonate at a second frequency lower than the first frequency and to be grounded in a second state at a switch point between the branching point and the open end.

DETAILED DESCRIPTION OF THE INVENTION

1. First Embodiment of the Present Invention

Figure 1:
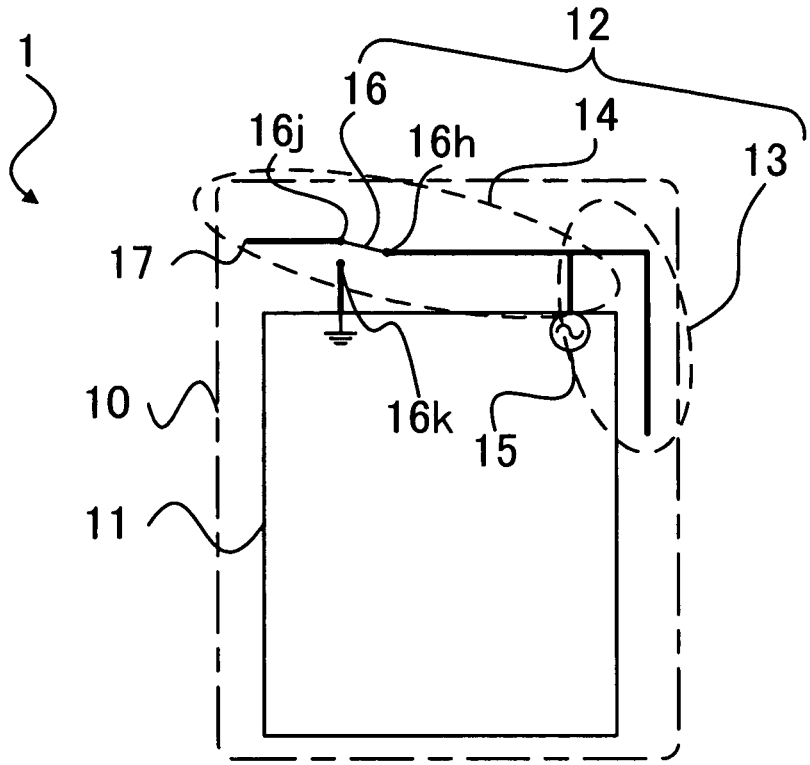
FIG. 1 shows a configuration of a radio apparatus and an antenna device of a first embodiment of the present invention.

A first embodiment of the present invention will be described with reference to FIGS. 1 to 6. FIG. 1 shows a configuration of a radio apparatus 1, including an antenna device, of the first embodiment. The radio apparatus 1 of the first embodiment has a case 10 indicated by a dot-and-dash line. The radio apparatus 1 has a printed board 11 and an antenna device 12 contained in the case 10.

The antenna device 12 includes a first antenna element 13 indicated as encircled by a dashed ellipse on a right hand side of FIG. 1, and a second antenna element 14 encircled by another dashed ellipse on a left hand side of FIG. 1. The first antenna element 13 and the second antenna element 14 are fed in common at a feeding point 15 located on the printed board 11. The first antenna element 13 is located near an end of the printed board 11, and so is the second antenna element 14.

The antenna device 12 includes a switch element 16 located at a middle location of the second antenna element 14, i.e., somewhere between both ends of the antenna element 14 and called a switch point of the antenna device 12. The switch element 16 has at least three terminals, **16*h*, 16*j* and 16*k*. In one state of the switch element 16, the terminals 16*h* and 16*j* are shorted and the terminal 16*k* is open. In another state of the switch element 16, the terminals 16*h* and 16*k* are shorted and the terminal 16*j* is open. The switch element 16 may be located on the printed board 11, but preferably apart from a ground pattern of the printed board 11**.

The terminal **16*h* is coupled to a portion of the second antenna element coupled to the feeding point 15. The terminal 16*j* is coupled to a portion of the second antenna element including an open end 17 of the second antenna element 14. The terminal 16*k* is coupled to the ground pattern of the printed board 11 and is thus grounded. Due to these couplings of the terminals 16*h*, 16*j* and 16*k*, the second antenna element 14** is grounded in one state (called a grounded state), and is not grounded in another state (called an ungrounded state).

Figure 2:
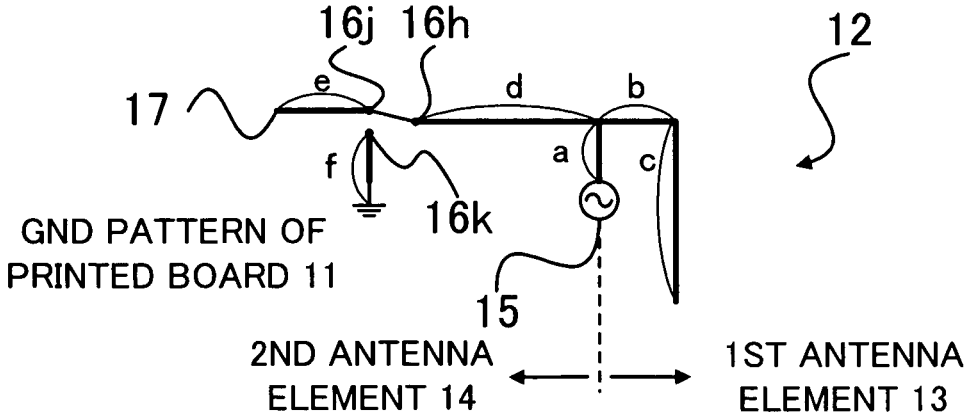
FIG. 2 shows how to represent a length of each portion and a total length of each of antenna elements included in the antenna device of the first embodiment.

How to represent a length of each portion and a total length of the first antenna element 13 and the second antenna element 14 will be explained with reference to FIG. 2. Each portion of the first antenna element 13 and the second antenna element 14 shown in FIG. 2 is a same as the corresponding one given the same reference numeral shown in FIG. 1, and its explanation is omitted. Each of small alphabet letters a to f shown in FIG. 2 represents a length of each portion of the first antenna element 13 and the second antenna element 14.

The first antenna element 13 has a starting portion of a length of a starting and going up from the feeding point 15, a following portion of a length of b going right, and an end portion of a length of c going downward. The first antenna element 13 is a monopole antenna having an open end, and has a total length of a+b+c. Hence, the first antenna element 13 has a resonant frequency on which the length of a+b+c corresponds to a quarter wavelength. Here and hereafter, the term "resonant frequency" means a series resonant frequency unless otherwise noted.

The second antenna element 14 has, in the ungrounded state, the starting portion of the length of a in common with the first antenna element 13, a following portion of a length of d going left, a switch portion between the terminals **16*h* and 16*j* of the switch element 16 (the reference numeral "16" is not shown in FIG. 2) and an end portion of a length e between the terminal 16*j* and an open end 17**.

The second antenna element 14 is, in the ungrounded state, a monopole antenna having the open end 17, and has a length of a+d+e if an electric length between the terminals **16*h* and 16*j* of the switch element 16 is neglected. Hence, the second antenna element 14 has a resonant frequency on which the length of a+d+e corresponds to a quarter wavelength in the ungrounded state. The resonant frequency of the second antenna element 14 in the ungrounded state is lower than that of the first antenna element 13** if a following inequality is true, i.e., $b+c<d+e$.

Figure 3:
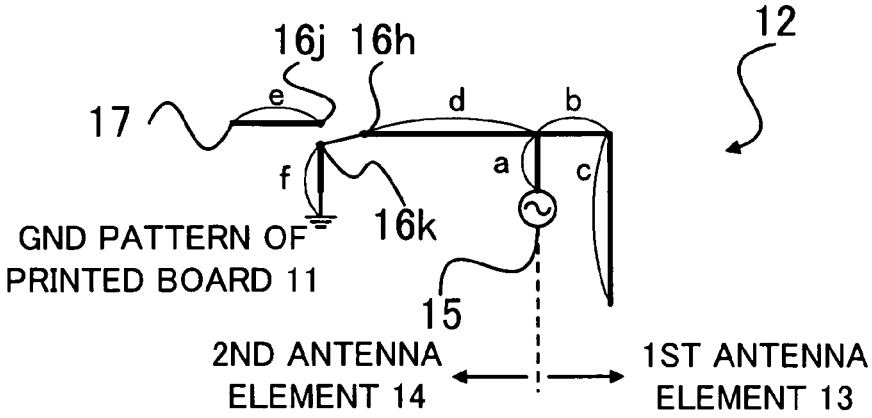
FIG. 3 is equivalent to FIG. 2 except for a state of a switch included in the antenna device of the first embodiment.

A configuration of the antenna device 12 in the grounded state of the second antenna element 14 will be explained with reference to FIG. 3 that is different from FIG. 2 only in the state of the switch element 16 (the reference numeral "16" is not shown in FIG. 3). Each portion or its length of the first antenna element 13 and the second antenna element 14 shown in FIG. 3 is a same as the corresponding one given the same reference numeral or the same small alphabet shown in FIG. 2, and its explanation is omitted.

In the grounded state of the second antenna element 14, the starting portion of the length of a, the following portion of the length of d, a switch portion between the terminals 16*h* and 16*k* of the switch element 16, and an end portion of a length of f going down from the terminal 16*k* are coupled in series one by one to form a line. The end portion of the length of f is grounded on the ground pattern of the printed board 11.

The line formed in the grounded state of the second antenna element 14 has a length of a+d+f, if an electric length between the terminals 16*h* and 16*k* of the switch element 16 is neglected. The line formed in the grounded state has an end coupled to the feeding point 15, and has another end that is grounded. As is known, the line formed in the grounded state performs as an antenna equivalent to a loop antenna twice as long as the line except for a value of input impedance. Hence, the line formed in the grounded state is an equivalent loop antenna having a resonant frequency on which the length of a+d+f corresponds to a half wavelength.

The resonant frequency of the equivalent loop antenna is nearly twice as high as the resonant frequency of the second antenna element 14 in the ungrounded state, if a following condition is true, i.e., e ≅f. The resonant frequency of the second antenna element 14 may thus be changed up to twice as high as its value of the ungrounded state if the switch element 16 is switched to the grounded state, and may be changed even higher if a following condition is true, i.e., f<e.

Figure 4:
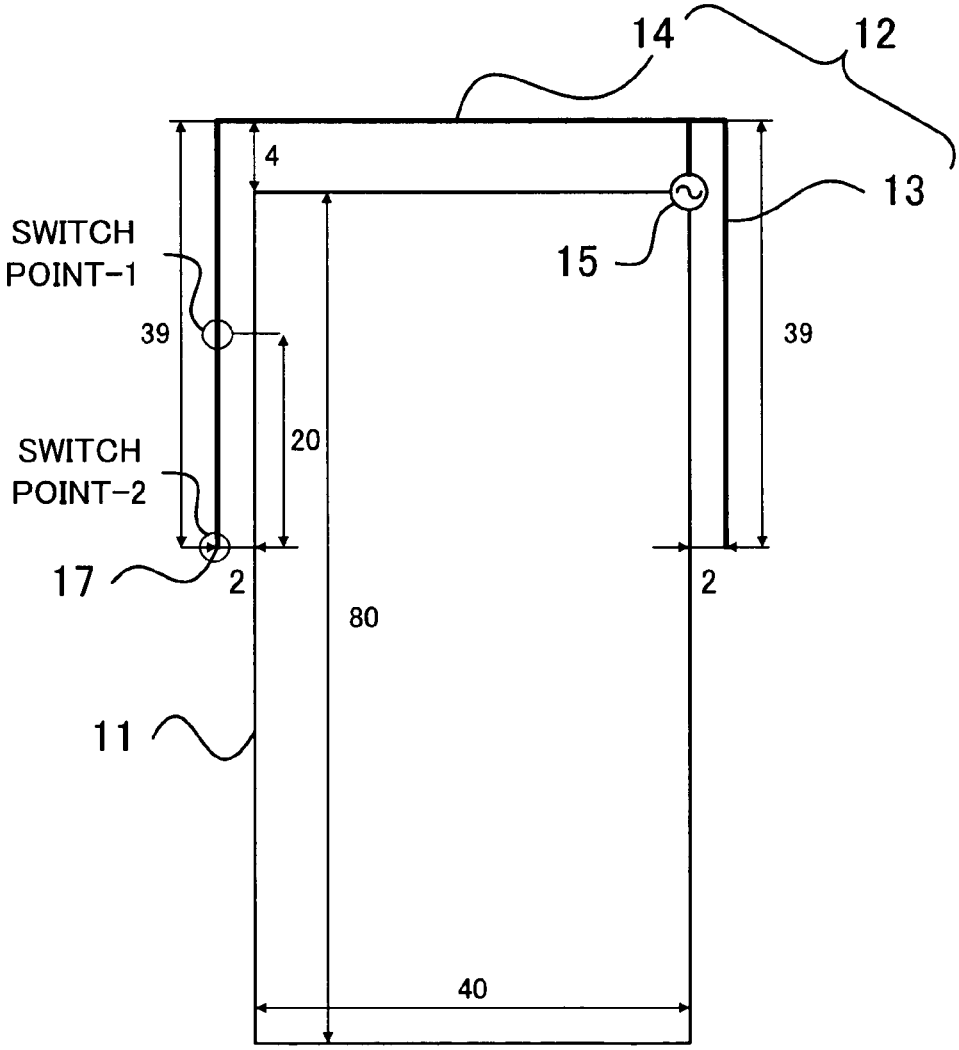
FIG. 4 shows a condition of a simulation for examining an effect of the first embodiment.

An effect of the first embodiment examined by simulation will be explained with reference to FIGS. 4 and 5. FIG. 4 shows a condition of the simulation. Each portion given a reference numeral 11 to 15 or 17 in FIG. 4 is a same as the corresponding one given the same reference numeral in FIG. 1. In FIG. 4, though, the end portion including the open end 17 of the second antenna element 14 is further turned to go downward. In FIG. 4, a length of each portion is indicated in millimeters (mm).

In FIG. 4, the feeding point 15 is located at a right upper corner of the printed board 11. The first antenna element 13 includes a portion 4 mm long going upward from the feeding point 15, a following portion 2 mm long going right, and an ending portion 39 mm long going downward. The second antenna element 14 includes the portion going upward from the feeding point 15, a following portion 42 mm long going left, and the ending portion 39 mm long going downward.

In the simulation, there is assumed a switch element (not shown in FIG. 4) corresponding to the switch element 16 shown in FIG. 1 to be located at a switch point-1, i.e., a middle location of the second antenna element 14 and 20 mm apart from the open end 17. FIG. 5 shows a frequency characteristic of a voltage standing wave ratio (VSWR) of the antenna device 12 simulated under the condition shown in FIG. 4. In FIG. 5, a horizontal axis represents the frequency in MHz, and a vertical axis represents the VSWR.

Figure 5:
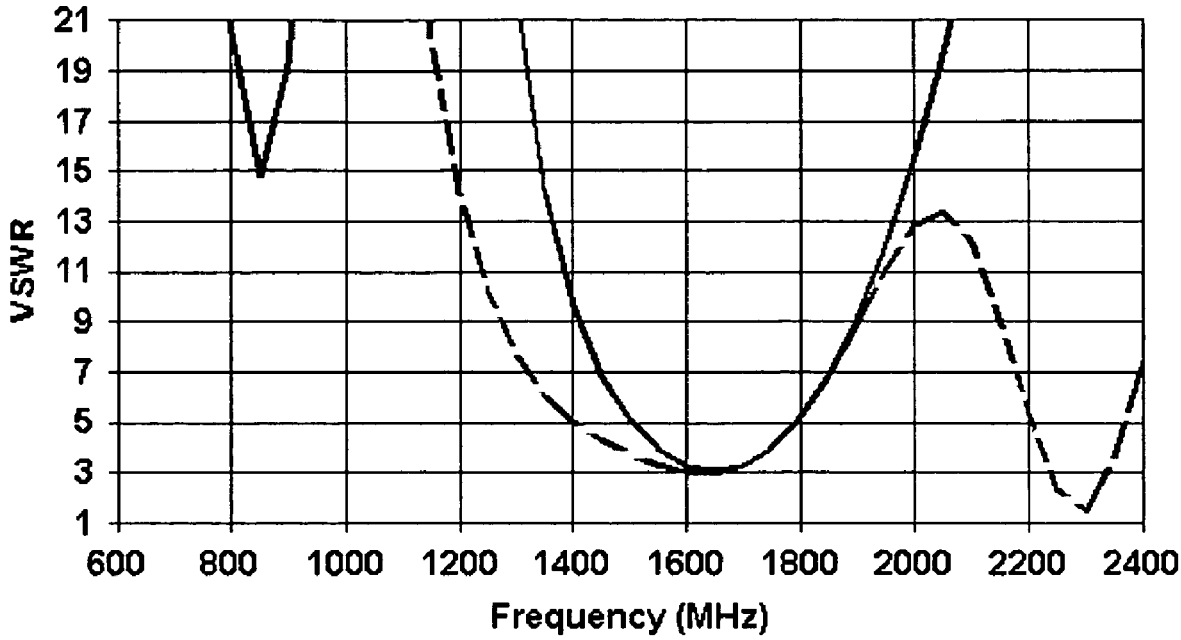
FIG. 5 shows a simulated characteristic of a voltage standing wave ratio (VSWR) over a frequency range of the antenna device of the first embodiment.

FIG. 5 shows a solid curve and a dashed curve. The solid curve represents a VSWR characteristic in a case where the second antenna element 14 is in the ungrounded state and has a full length including the open end 17. The dashed curve represents a VSWR characteristic in a case where the second antenna element 14 is grounded at the switch point-1 to form equivalently a loop antenna and the portion including the open end 17 is separated.

On the solid curve, i.e., the VSWR characteristic in the ungrounded state, a peak at a frequency of nearly 850 MHz is a resonant frequency of the second antenna element 14 (here and hereafter, a peak that looks down is simply called a peak). On the solid curve, a peak at a frequency of nearly 1600 MHz is a resonant frequency of the first antenna element 13.

On the dashed curve, i.e., the VSWR characteristic in the grounded state, a peak at a frequency of nearly 2300 MHz is a resonant frequency of the loop antenna equivalently formed by the second antenna element 14. On the dashed curve, a peak at a frequency of nearly 1600 MHz is the resonant frequency of the first antenna element 13. As the switch point-1 is 20 mm apart from the open end 17 and the condition f<e is true as in FIG. 3, the resonant frequency of the equivalent loop antenna is more than twice as high as the resonant frequency of the second antenna element 14 in the ungrounded state.

As shown in FIG. 5, the VSWR characteristic on the dashed curve is better than that on the solid curve over a frequency range 1200 to 1600 MHz. That is because the second antenna element 14 grounded at the switch point-1 works as a stub for the first antenna element 13.

Figure 6:
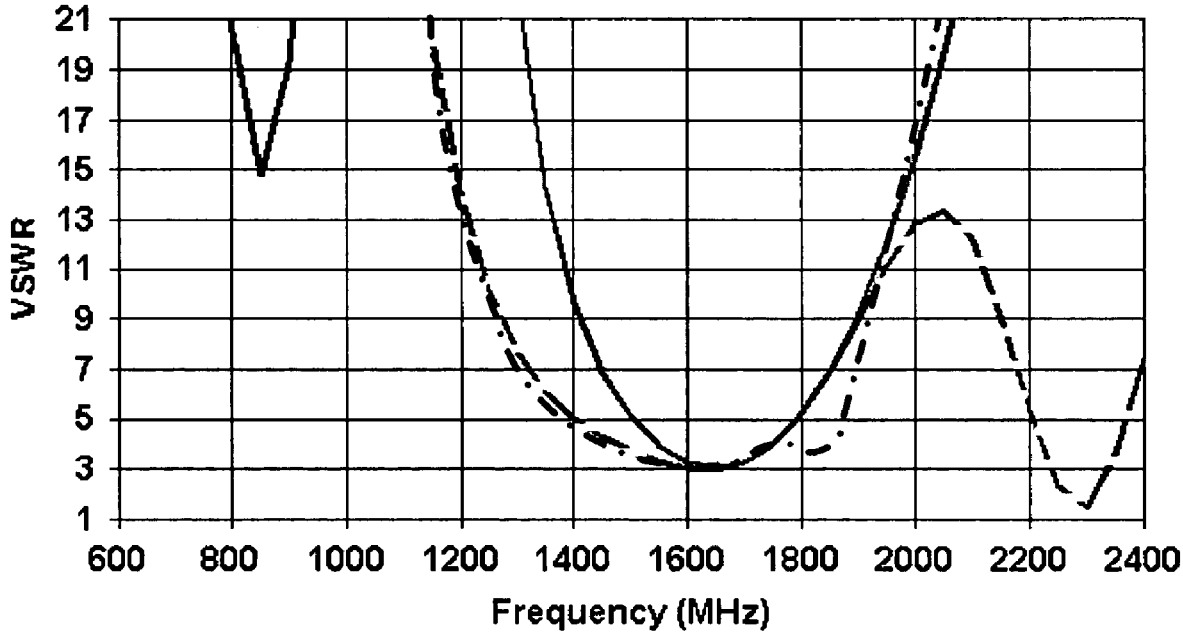
FIG. 6 is equivalent to FIG. 5 except that an extra VSWR characteristic after a change of a switch point is added.

In the simulation, there may be assumed a switch element (not shown in FIG. 4) corresponding to the switch element 16 shown in FIG. 1 to be located not at the switch point-1 but at a switch point-2, i.e., the open end 17. FIG. 6 shows a horizontal axis, a vertical axis, a solid curve and a dashed curve, each of which is a same as the corresponding one shown in FIG. 5. In addition, FIG. 6 shows a dot-and-dash curve, i.e., a VSWR characteristic of the antenna device 12 simulated under the condition where the switch element is assumed to be located not at the switch point-1 but at the switch point-2, and the second antenna element 14 is in the grounded state.

As the switch point-2 coincides with the open end 17, the equivalent loop antenna formed in the grounded state has a resonant frequency that is nearly twice as high as the resonant frequency of the second antenna element 14 in the ungrounded state. Depending on where the switch element 16 is located on the second antenna element 14, a high/low relationship of the resonant frequencies may be adjusted between the second antenna element 13 and the equivalent loop antenna formed in the grounded state of the second antenna element 14. The antenna device 12 may thus broaden its frequency characteristic as a whole.

The present invention may be applied as long as the second antenna element 14 is a monopole antenna having an open end and a portion thereof may be grounded as shown in FIGS. 1 to 3. Hence, the first antenna element 13 may not be a monopole antenna having an open end as long as being unbalanced-fed. In that case, the condition explained with reference to FIG. 2, i.e., b+c<d+e, is replaced by a condition that a total length of the second antenna element 14 in the ungrounded state is greater than the quarter wavelength of the resonant frequency of the first antenna element 13.

According to the first embodiment described above, a built-in antenna device of a radio apparatus may significantly change or broaden its frequency characteristic by locating a switch element at a middle location of an antenna element of the antenna device and by turning the switch element on and off.

2. Second Embodiment of the Present Invention

Figure 7:
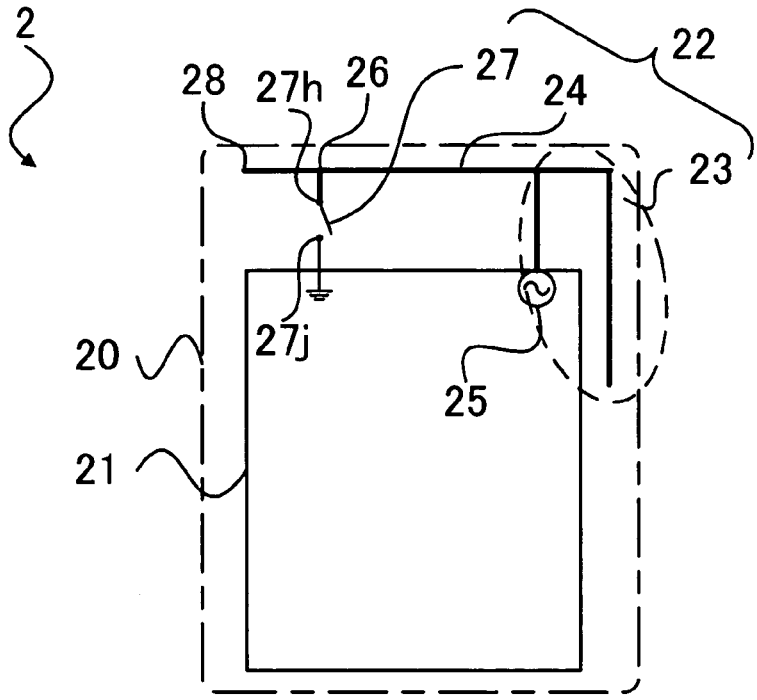
FIG. 7 shows a configuration of a radio apparatus and an antenna device of a second embodiment of the present invention.

A second embodiment of the present invention will be described with reference to FIGS. 7 to 12. FIG. 7 shows a configuration of a radio apparatus 2, including an antenna device, of the second embodiment. The radio apparatus 2 of the second embodiment has a case 20 indicated by a dot-and-dash line. The radio apparatus 2 has a printed board 21 and an antenna device 22 contained in the case 20.

The antenna device 22 includes a first antenna element 23 indicated as encircled by a dashed ellipse on a right hand side of FIG. 7, and a second antenna element 24 on a left hand side of FIG. 7. The first antenna element 23 and the second antenna element 24 are fed in common at a feeding point 25 located on the printed board 21. The first antenna element 23 is located near an end of the printed board 21, and so is the second antenna element 24.

The antenna device 22 has a switch point 26 which is a middle location of the second antenna element 24. The antenna device 22 includes a switch element 27 coupled to the switch point 26. The second antenna element 24 is a monopole antenna having an open end 28 formed by a line between the feeding point 25 and the open end 28. The switch element 27 has at least two terminals, 27*h* and 27*j*. In one state of the switch element 27, the terminals 27*h* and 27*j* are shorted. In another state of the switch element 27, the terminals 27*h* and 27*j* are open. The switch element 27 may be located on the printed board 21.

The terminal 27*h* is coupled to the switch point 26. The terminal 27*j* is coupled to the ground pattern of printed board 21 and is thus grounded. Due to these couplings of the terminals 27*h* and 27*j*, the second antenna element 24 is grounded at the switch point 26 in one state (called a grounded state), and is not grounded in another state (called an ungrounded state).

Figure 8:
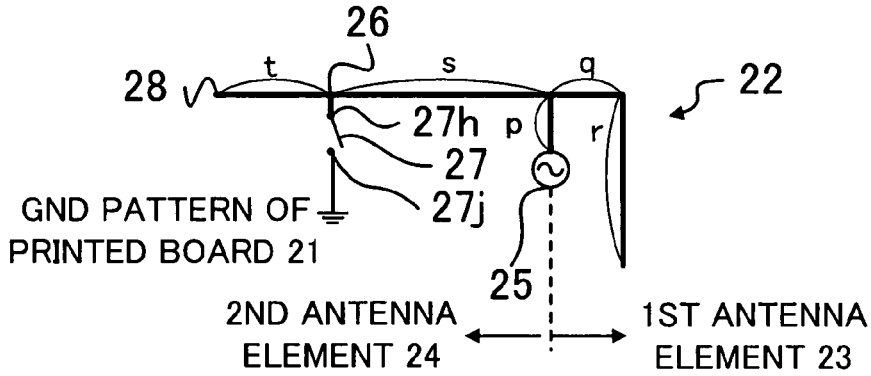
FIG. 8 shows how to represent a length of each portion and a total length of each of antenna elements included in the antenna device of the second embodiment.
Figure 9:
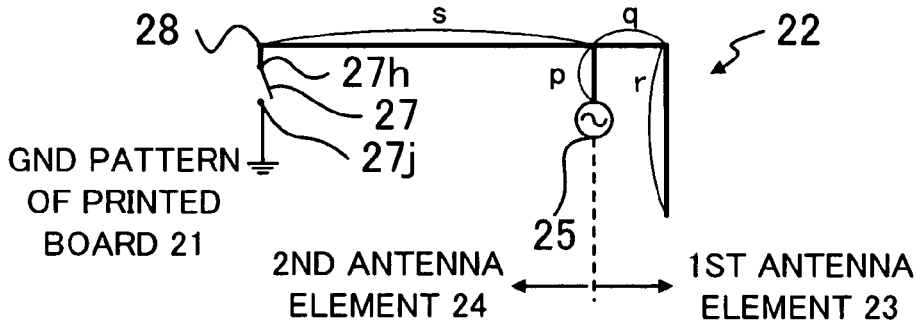
FIG. 9 shows how to represent a length of each portion and a total length of each of antenna elements included in a variation of the antenna device of the second embodiment.

How to represent a length of each portion and a total length of the first antenna element 23 and the second antenna element 24 will be explained with reference to FIGS. 8 and 9. Each portion of the first antenna element 23 and the second antenna element 24 shown in FIG. 8 is a same as the corresponding one given the same reference numeral shown in FIG. 7, and its explanation is omitted. In FIG. 8, the switch element 27 is being open. Each of small alphabet letters p to u shown in FIG. 8 represents a length of each portion of the first antenna element 23 and the second antenna element 24.

The first antenna element 23 has a starting portion of a length of p starting and going up from the feeding point 25, a following portion of a length of q going right, and an end portion of a length of r going downward. The first antenna element 23 is a monopole antenna having an open end, and has a total length of p+q+r. Hence, the first antenna element 23 has a resonant frequency on which the length of p+q+r corresponds to a quarter wavelength.

The second antenna element 24 has the starting portion of the length of p in common with the first antenna element 23, a following portion of a length of s going left and reaching the switch point 26, and an end portion of the length of t between the switch point 26 and the open end 28. The second antenna element 24 has a total length of p+s+t.

Hence, the second antenna element 24 has a resonant frequency on which the length of p+s+t corresponds to a quarter wavelength. The resonant frequency of the second antenna element 24 is lower than that of the first antenna element 23 if a following inequality is true, i.e., q+r<s+t. FIG. 9 shows a variation of FIG. 8, in which the switch point 26 coincides with the open end 28, i.e., t=0.

Figure 10:
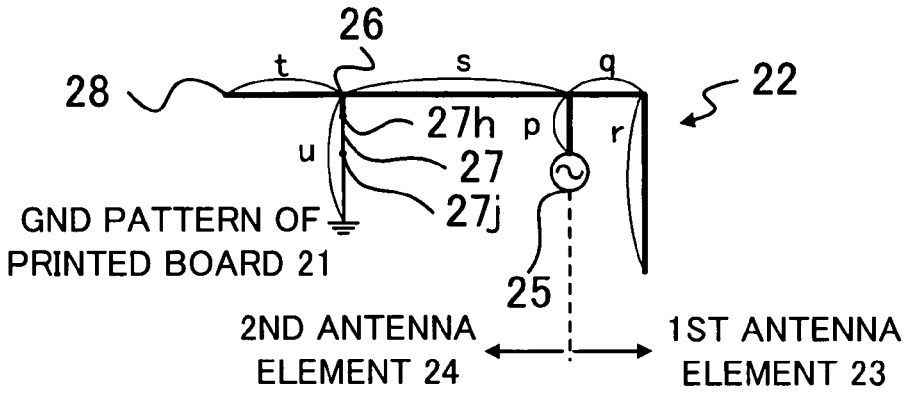
FIG. 10 is equivalent to FIG. 8 except for a state of a switch included in the antenna device of the second embodiment.

A configuration of the antenna device 22 in the grounded state of the second antenna element 24 will be explained with reference to FIG. 10 that is different from FIG. 8 only in the state of the switch element 27 (the reference numeral "27" is not shown in FIG. 10). Each portion or its length of the first antenna element 23 and the second antenna element 24 shown in FIG. 10 is a same as the corresponding one given the same reference numeral or the same small alphabet shown in FIG. 8, and its explanation is omitted.

In the grounded state of the second antenna element 24, the starting portion of the length of p, the following portion of the length of s, a switch portion between the terminals 27*h* and 27*j* of the switch element 27 and a portion between the switch point 26 and the ground pattern of the printed board 21 are coupled in series one by one to form a line. Let a length of the portion between the switch point 26 and the ground pattern of the printed board 21 be u.

The line formed in the grounded state of the second antenna element 24 has a length of p+s+u, if an electric length between the terminals 27*h* and 27*j* of the switch element 27 is neglected. As described regarding the first embodiment, the line formed in the grounded state performs as an antenna equivalent to a loop antenna twice as long as the line except for a value of input impedance.

The equivalent loop antenna has a resonant frequency on which the length of p+s+u corresponds to a half wavelength. The resonant frequency of the equivalent loop antenna is nearly twice as high as the resonant frequency of the second antenna element 24 in the ungrounded state, if a following condition is true, i.e., t≅u. The resonant frequency of the second antenna element 24 may thus be changed up to twice as high as its value in the ungrounded state if the switch element 27 is switched to the grounded state, and may be changed even higher if a following condition is true, i.e., u<t.

If the antenna device 22 is configured according to FIG. 4, the antenna device 22 has a VSWR characteristic which is a same as the solid curve shown in FIG. 5. A frequency characteristic of the antenna device 22 in the grounded state of the second antenna element 24 is determine by resonant frequencies of the first antenna element 23, the equivalent loop antenna mentioned above and an antenna element of a length of t between the switch point 26 and the open end 28 performing as a quarter wavelength monopole antenna.

Assume that q+r<s+t and the resonant frequency of the first antenna element 23 is higher than that of the second antenna element 24 in the ungrounded state. In that case, a portion of the first antenna element 23 of a length of q+r and a portion of the second antenna element 24 of a length of s+t cause, as a whole, parallel resonance at a frequency on which a length of q+r+s+t corresponds to a half wavelength. The parallel resonant frequency is lower than the resonant frequency of the first antenna element 23 and higher than that of the second antenna element 24 (refer to p. 201 of Sekine and Shoki previously mentioned). At the parallel resonant frequency, the input impedance of the antenna device 22 may increase and may cause a mismatch.

In a case where the radio apparatus 2 operates in a frequency range between the resonant frequencies of the first antenna element 23 and the second antenna element 24, the parallel resonant frequency in the ungrounded state of the second antenna element 24 may be included in the above frequency range. By closing the switch element 27 and forming the equivalent loop antenna, the antenna device 22 may cover the frequency range while avoiding the parallel resonance.

Figure 11:
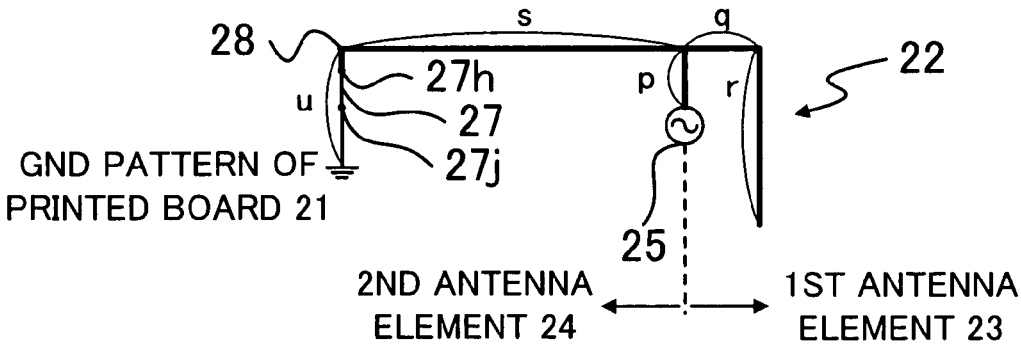
FIG. 11 is equivalent to FIG. 9 except for a state of a switch included in the antenna device of the second embodiment.

In a case where q+r<t, though, a frequency of parallel resonance caused by the first antenna element 23 and the antenna element of the length of t between the switch point 26 and the open end 28 may be lower than the resonant frequency of the first antenna element 23, and may be included in the above frequency range. The antenna device 22 may avoid the parallel resonant frequency from remaining in the above frequency range by letting t<q+r. FIG. 11 shows a variation of FIG. 10, in which the switch point 26 coincides with the open end 28, i.e., t=0.

Figure 12:
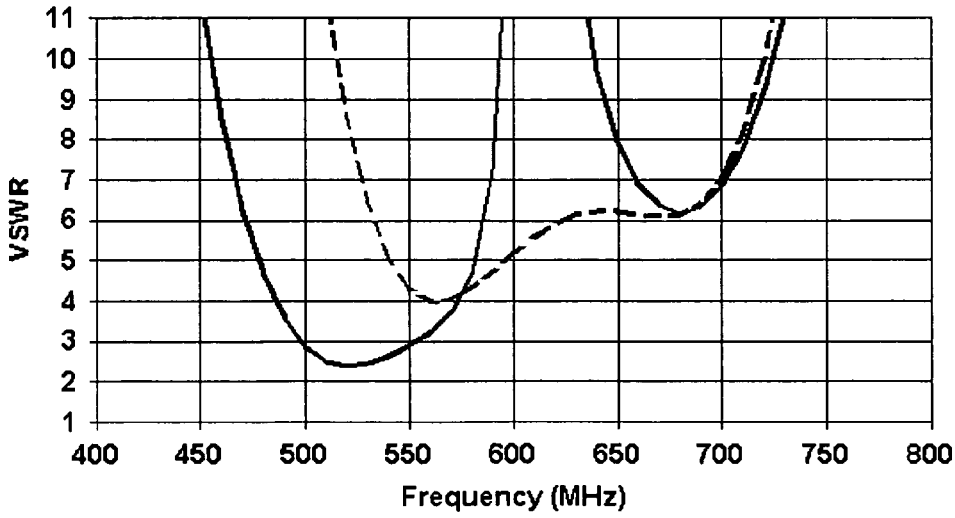
FIG. 12 shows a simulated VSWR characteristic over a frequency range of the antenna device of the second embodiment.

FIG. 12 shows a simulated frequency characteristic of a voltage standing wave ratio (VSWR) of the antenna device 22 configured to avoid the parallel resonant frequency from remaining between two resonant frequencies in the ungrounded state of the second antenna element 24 by switching that to the grounded state. In that simulation, the antenna device 22 is assumed to have a meander element and to operate in an UHF band.

In FIG. 12, a solid curve shows a VSWR characteristic indicating two separate resonant frequencies in the ungrounded state. A dashed curve shows a VSWR characteristic indicating that an interval between the two separate frequencies is covered by a resonant frequency generated in the grounded state and the parallel resonance is avoided.

The first antenna element 23 may not be a monopole antenna having an open end as long as being unbalanced-fed, as the first antenna element 13 of the first embodiment may not either. In that case, the condition explained with reference to FIG. 8, i.e., q+r<s+t, is replaced by a condition that a total length of the second antenna element 24 in the ungrounded state is greater than the quarter wavelength of the resonant frequency of the first antenna element 23.

According to the second embodiment described above, obtained is an effect similar to that of the first embodiment while avoiding parallel resonance.

3. Third Embodiment of the Present Invention

Figure 13:
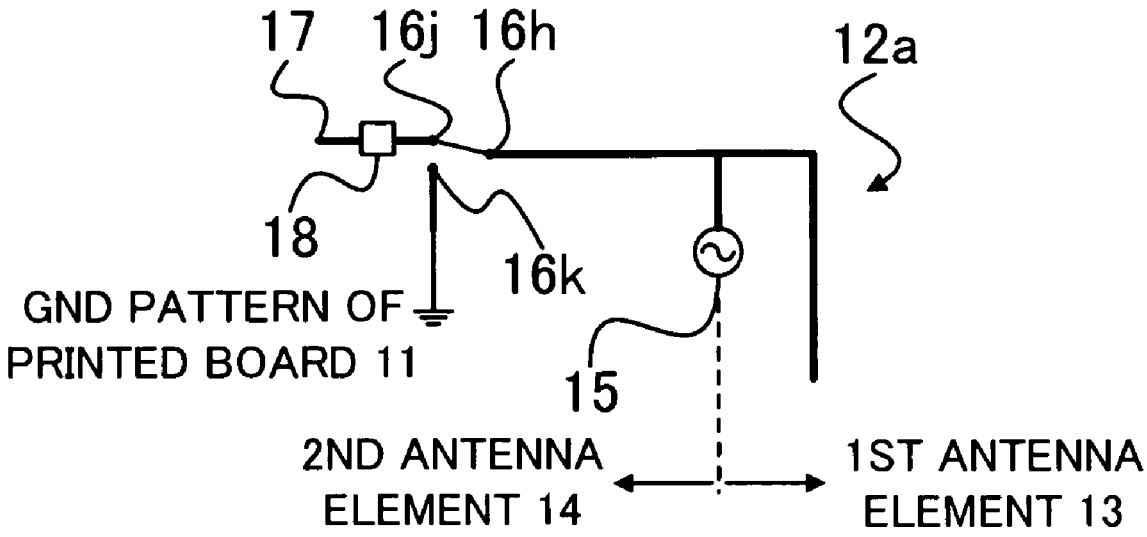
FIG. 13 shows a first configuration of an antenna device of a third embodiment of the present invention.
Figure 14:
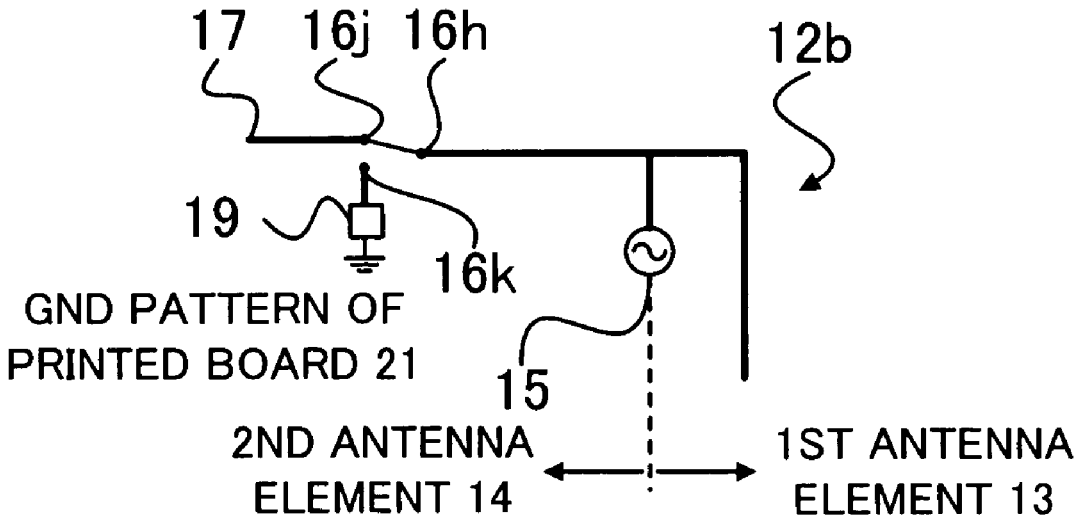
FIG. 14 shows a second configuration of an antenna device of a third embodiment of the present invention.
Figure 15:
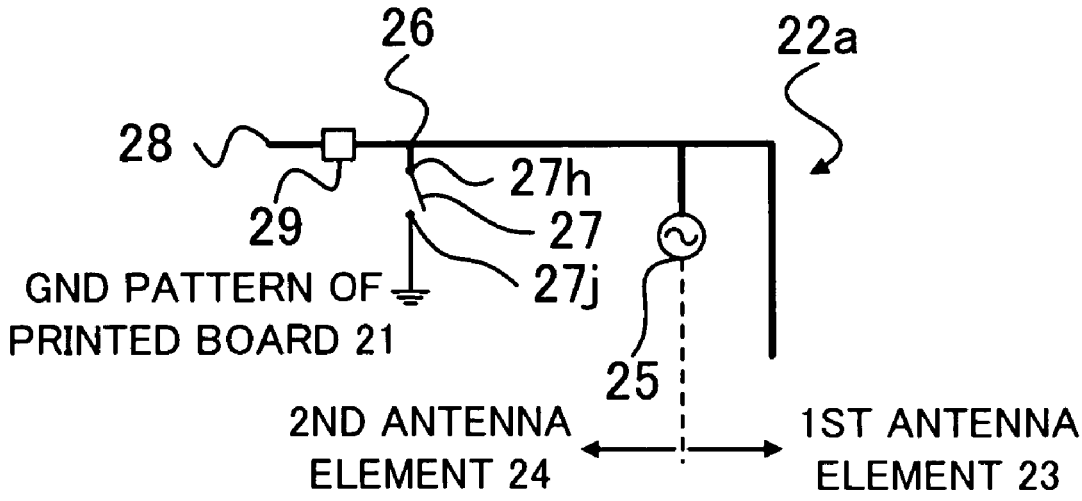
FIG. 15 shows a third configuration of an antenna device of a third embodiment of the present invention.
Figure 16:
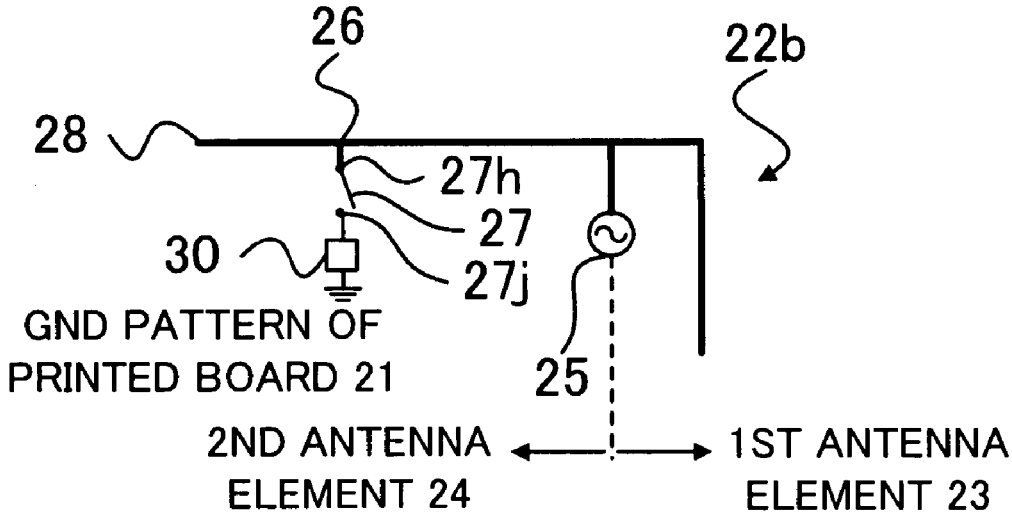
FIG. 16 shows a fourth configuration of an antenna device of a third embodiment of the present invention.

A third embodiment of the present invention will be described with reference to FIGS. 13 to 16. FIGS. 13 and 14 show configurations of antenna devices 12*a* and 12*b*, respectively, of the third embodiment. FIGS. 15 and 16 show configurations of antenna devices 22*a* and 22*b*, respectively, of the third embodiment.

The antenna device 12*a* shown in FIG. 13 is configured in such a way that the antenna device 12 of the first embodiment shown in FIG. 2 is loaded with a reactance element 18 between the switch point of the antenna device 12 (or the terminal 16*j* of the switch element 16) and the open end 17. Each of remaining portions of the antenna device 12*a* is a same as the corresponding one shown in FIG. 2 given the same reference numeral, and its explanation is omitted.

The antenna device 12*b* shown in FIG. 14 is configured in such a way that the antenna device 12 of the first embodiment shown in FIG. 2 is loaded with a reactance element 19 between the switch point of the antenna device 12 (or the terminal 16*k* of the switch element 16) and the ground pattern of the printed board 11. Each of remaining portions of the antenna device 12*b* is a same as the corresponding one shown in FIG. 2 given the same reference numeral, and its explanation is omitted.

The antenna device 22*a* shown in FIG. 15 is configured in such a way that the antenna device 22 of the second embodiment shown in FIG. 8 is loaded with a reactance element 29 between the switch point 26 of the antenna device 22 and the open end 28. Each of remaining portions of the antenna device 22*a* is a same as the corresponding one shown in FIG. 8 given the same reference numeral, and its explanation is omitted.

The antenna device 22*b* shown in FIG. 16 is configured in such a way that the antenna device 22 of the second embodiment shown in FIG. 8 is loaded with a reactance element 30 between the terminal 27*j* of the switch element 27 and the ground pattern of the printed board 21. Each of remaining portions of the antenna device 22*b* is a same as the corresponding one shown in FIG. 8 given the same reference numeral, and its explanation is omitted.

Being loaded with the reactance element 18, the antenna device 12*a* may change an effective length of the second antenna element 14 so that the resonant frequency or the input impedance of the antenna device 12*a* may be adjusted. So may the resonant frequency or the input impedance of each of the antenna devices 12*b*, 22*a* and 22*b* loaded with the reactance elements 19, 29 and 30, respectively.

If values of the reactance elements 18, etc., are variable, the above adjustment may be made in a broader range. For the adjustment, the conditions of the lengths of the antenna elements explained with reference to FIGS. 2 and 8 need to be satisfied with the effective lengths of the antenna elements.

In FIG. 13, the antenna device 12*a* may further be loaded with the reactance element 19 shown in FIG. 14 between the terminal 16*k* of the switch element 16 and the ground pattern of the printed board 11. In FIG. 15, the antenna device 22*a* may further be loaded with the reactance element 30 shown in FIG. 16 between the terminal 27*j* of the switch element 27 and the ground pattern of the printed board 21.

The switch element 16 may be located on the printed board 11, and so may the reactance elements 18 and 19. The switch element 27 may be located on the printed board 21, and so may the reactance elements 29 and 30.

According to the third embodiment described above, obtained is an additional effect that a resonant frequency or input impedance of an antenna device may be more easily adjusted.

4. Fourth Embodiment of the Present Invention

Figure 17:
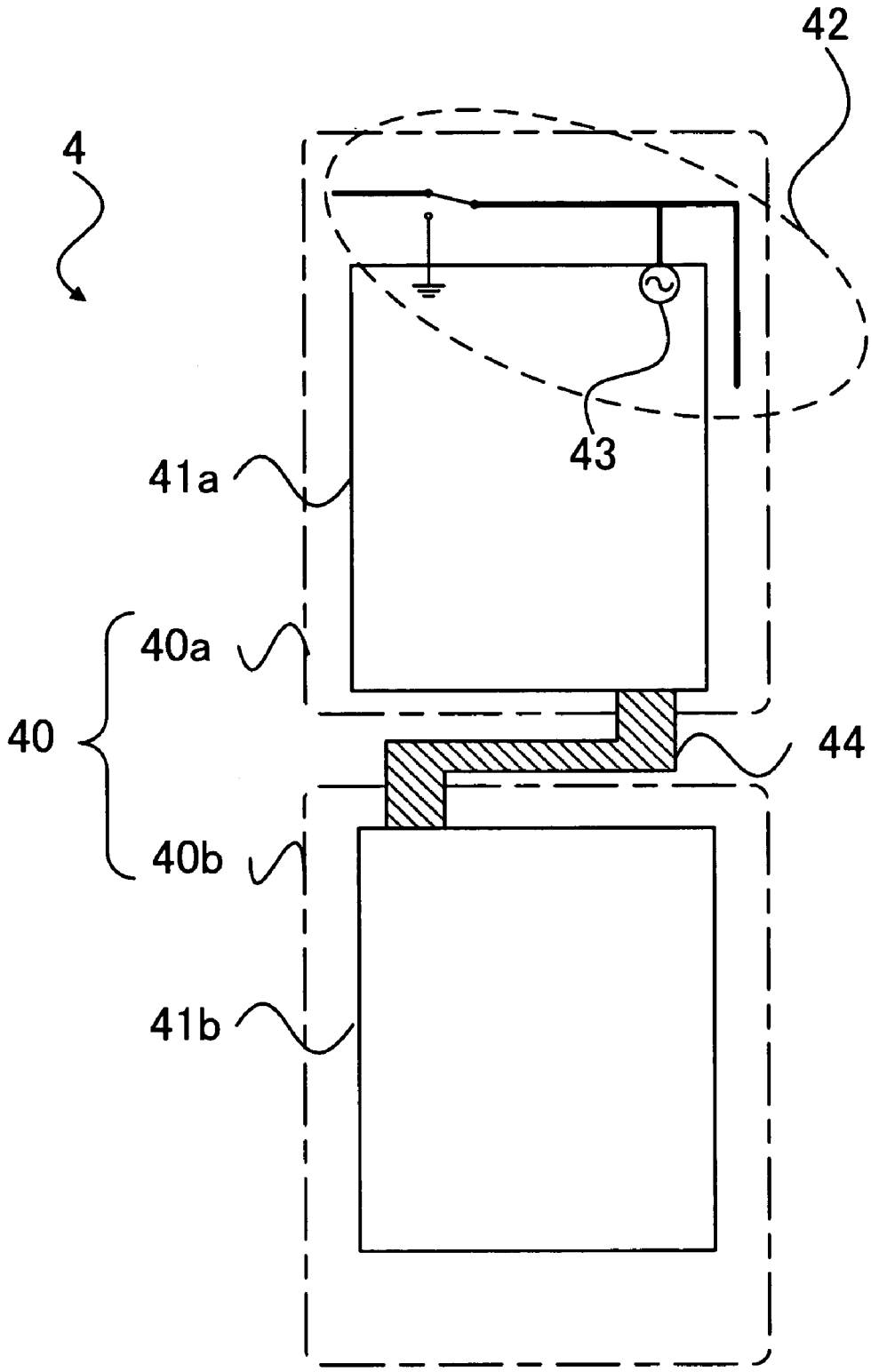
FIG. 17 shows a configuration of a radio apparatus of a fourth embodiment of the present invention.

A fourth embodiment of the present invention will be described with reference to FIGS. 17 to 21. FIG. 17 shows a configuration of a radio apparatus 4, including an antenna device, of the fourth embodiment. The radio apparatus 4 has a case 40 formed by a first case 40*a* and a second case 40*b* connected to each other by a connection (not shown). The first case 40*a* and the second case 40*b* are indicated by a dot-and-dash line in FIG. 17. The first case 40*a* and the second case 40*b* contain a printed board 41*a* and a printed board 41*b*, respectively.

The first case 40*a* contains an antenna device 42 indicated as encircled by a dashed ellipse. The antenna device 42 has a same configuration as that of the antenna device 12 shown in FIG. 1, and its explanation is omitted. The antenna device 42 is fed from a feeding point 43 located on the printed board 41*a*. A relationship among the first case 40*a*, the printed board 41*a*, the antenna device 42 and the feeding point 43 is a same as a relationship among the case 10, the printed board 11, the antenna device 12 and the feeding point 15 of the first embodiment.

The printed boards 41*a* and 41*b* are coupled to each other by a flexible printed board 44. The printed board 41*a* has a ground pattern that is coupled to a ground pattern of the printed board 41*b* via a conductor pattern printed on the flexible printed board 44. The antenna device 42 then provides a return current from the feeding point 43 along a current path formed on the ground pattern of the printed board 41*a*, the conductor pattern of the flexible printed board 44 and the ground pattern of the printed board 41*b*. As, more often than not, the current path is longer than an antenna element included in the antenna device 42, the return current acts on the antenna device 42 so as to decrease a lower resonant frequency thereof.

Figure 18:
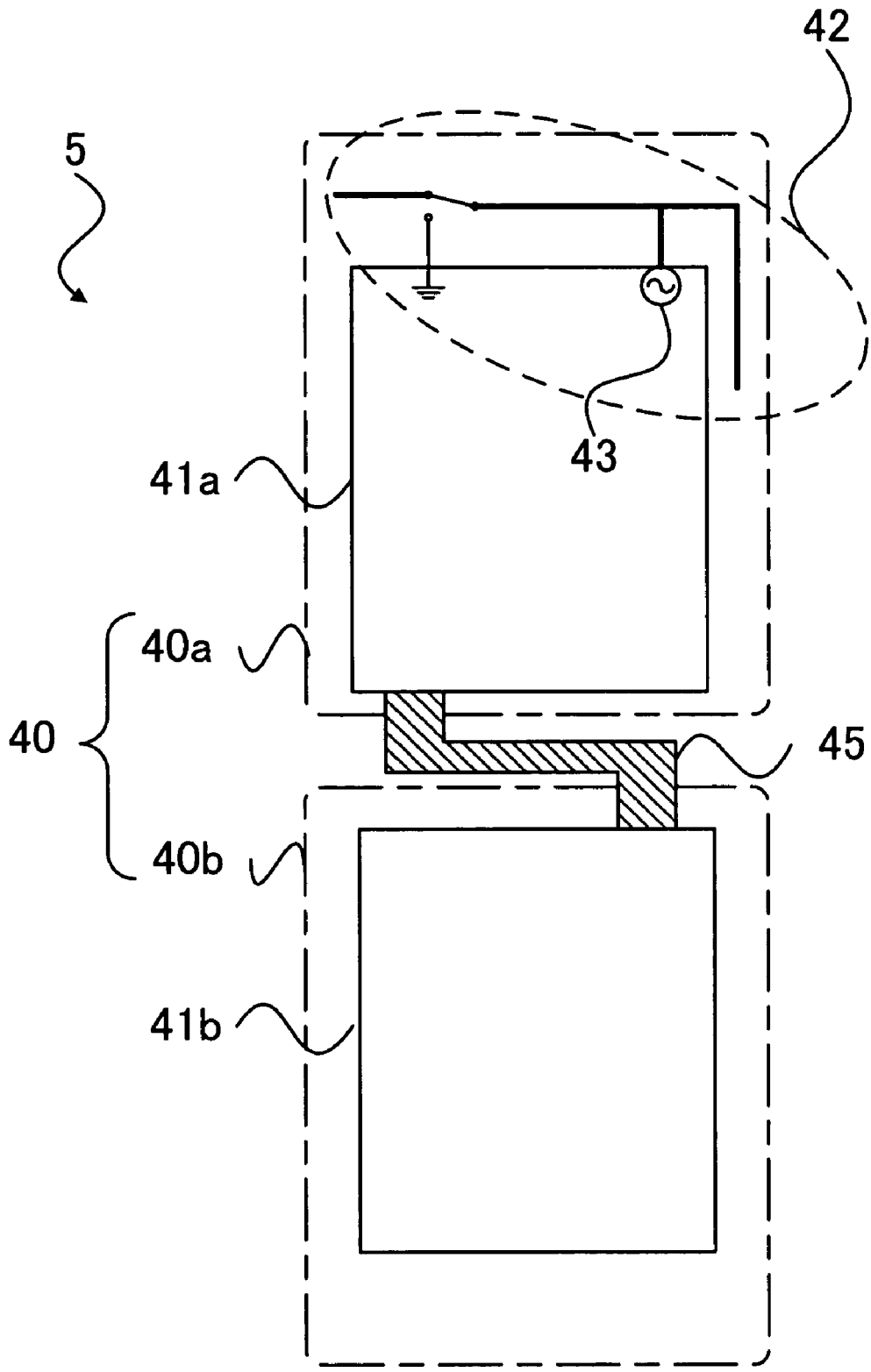
FIG. 18 shows a configuration of a variation of the radio apparatus of a fourth embodiment of the present invention.

FIG. 18 shows a configuration of a radio apparatus 5 of the fourth embodiment. The radio apparatus 5 differs from the radio apparatus 4 in that the radio apparatus 5 has a flexible printed board 45 that is right-left reversed against the flexible printed board 44 of the radio apparatus 4 shown in FIG. 17. The flexible printed board 45 is coupled to the printed board 41*a* on an end nearer to the printed board 41*b* and farther from the feeding point 43. Each of remaining portions of the radio apparatus 5 is a same as the corresponding one given the same reference numeral shown in FIG. 17, and its explanation is omitted.

In FIG. 18, the antenna device 42 provides a return current from the feeding point 43 along a current path formed on the ground pattern of the printed board 41*a*, the conductor pattern of the flexible printed board 45 and the ground pattern of the printed board 41*b*. As the current path formed in FIG. 18 is longer than the current path formed in FIG. 17, the return current acts on the antenna device 42 so as to moreover decrease the lower resonant frequency thereof.

Figure 19:
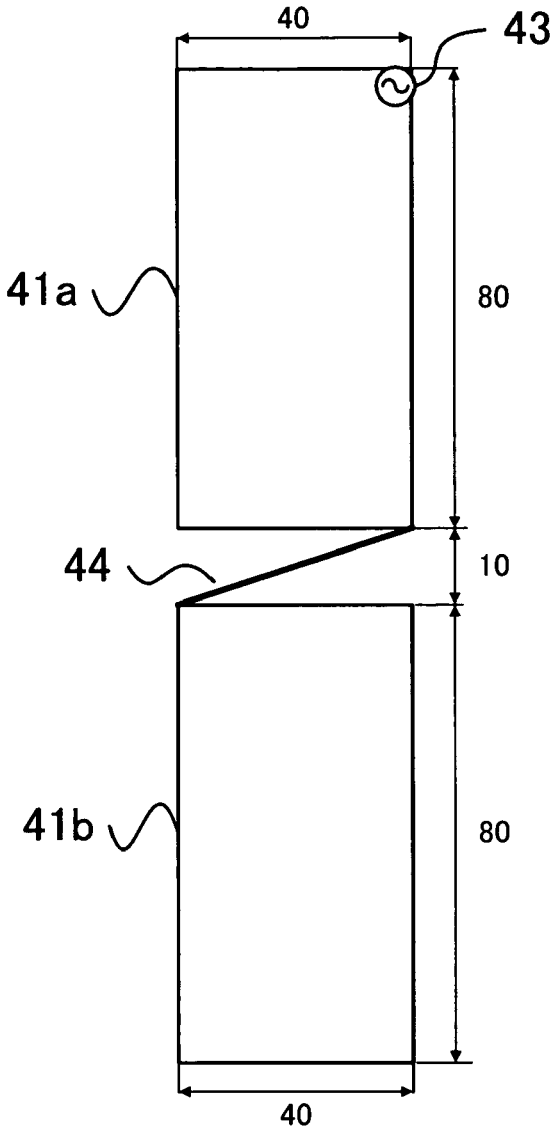
FIG. 19 shows a condition of a simulation for examining an effect of the fourth embodiment corresponding to FIG. 17.

An effect of the fourth embodiment examined by simulation will be explained with reference to FIGS. 19 to 21. FIG. 19 corresponds to FIG. 17, and shows a condition of the simulation regarding a relative position between the printed boards 41*a* and 41*b*, and regarding a relationship between an orientation of the flexible printed board 44 and a location of the feeding point 43.

Each portion shown in FIG. 19 represents the corresponding one shown in FIG. 17 and given the same reference numeral, 41*a*, 41*b*, 43 or 44. In FIG. 19, lengths are indicated in millimeters (mm). The printed boards 41*a* and 41*b* are separated 10 mm apart and arranged in a direction of their long sides. The printed boards 41*a* and 41*b* are coupled to each other along a diagonal line representing the flexible printed board 44.

Figure 20:
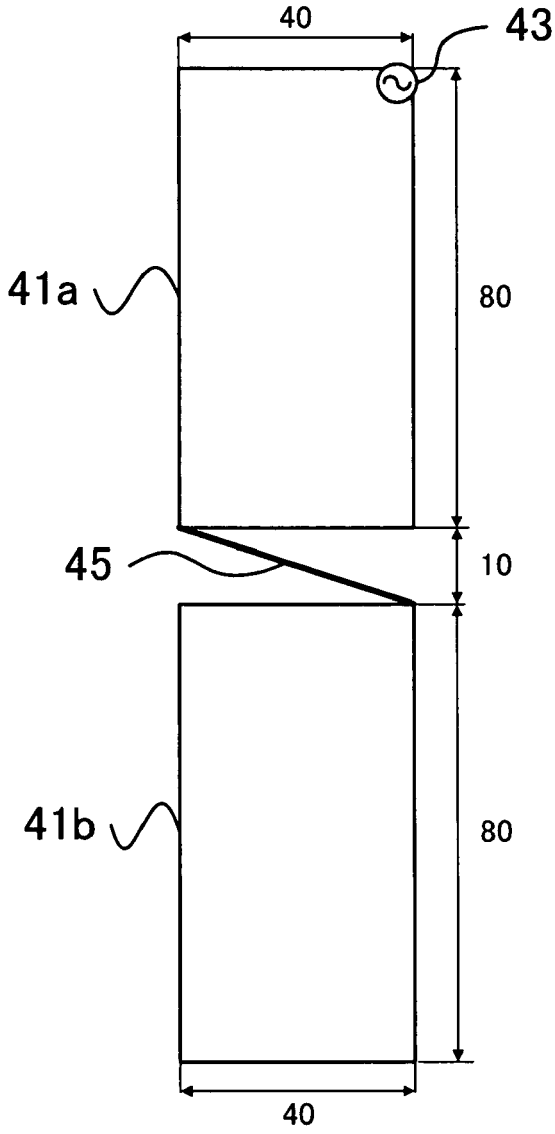
FIG. 20 shows a condition of a simulation for examining an effect of the fourth embodiment corresponding to FIG. 18.

FIG. 20 corresponds to FIG. 18, and shows a condition of the simulation as well as FIG. 19. Each portion shown in FIG. 20 represents the corresponding one shown in FIG. 17 and given the same reference numeral, 41*a*, 41*b*, 43 or 45. In FIG. 20, the printed board 41*a* is coupled to the printed board 41*b* from the farther end along a right-left reversed diagonal line representing the flexible printed board 45. There is no difference between FIGS. 19 and 20 other than that.

Figure 21:
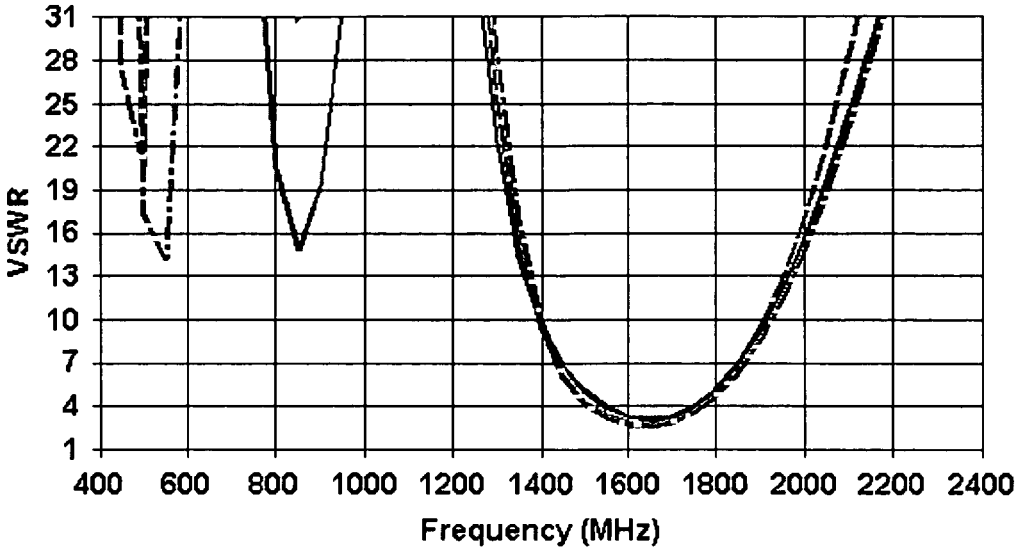
FIG. 21 shows a simulated VSWR characteristic over a frequency range of the antenna device of the fourth embodiment.

FIG. 21 shows a VSWR characteristic of the antenna device 42 simulated under the condition shown in FIGS. 19 and 20 in comparison with the VSWR characteristic of the antenna device 12 of the first embodiment shown in FIG. 5. FIG. 21 shows same horizontal and vertical axes as those shown in FIG. 5.

FIG. 21 shows a solid curve, a dot-and-dash curve and a dashed curve. The solid curve represents the VSWR characteristic of the antenna device 12 of the first embodiment being in the ungrounded state. The dot-and-dash curve represents the VSWR characteristic of the antenna device 42 included in the radio apparatus 4 shown in FIG. 17, simulated under the condition shown in FIG. 19. The dashed curve represents the VSWR characteristic of the antenna device 42 included in the radio apparatus 5 shown in FIG. 18, simulated under the condition shown in FIG. 20.

As shown in FIG. 21, the lower peak moves left, i.e., the lower resonant frequency decreases, in an order of the solid curve, the dot-and-dash curve and the dashed curve. The solid curve represents a case where the printed board 41*b* is not present. The dot-and-dash curve represents a case where the printed board 41*b* is present. The dashed curve represents a case where the printed board 41*b* is present and a connection between the printed board 41*a* and the flexible printed board 45 is kept away from the feeding point 43.

As described above, the antenna device 42 is assumed to have a same configuration as that of the antenna device 12 of the first embodiment shown in FIG. 1. The antenna device 42 may have a same configuration as that of the antenna device 22 of the second embodiment shown in FIG. 7.

According to the fourth embodiment described above, obtained is an additional effect that a lower resonant frequency of an antenna device may further be decreased depending on a configuration of a radio apparatus having a plurality of cases.

5. Fifth Embodiment of the Present Invention

Figure 22:
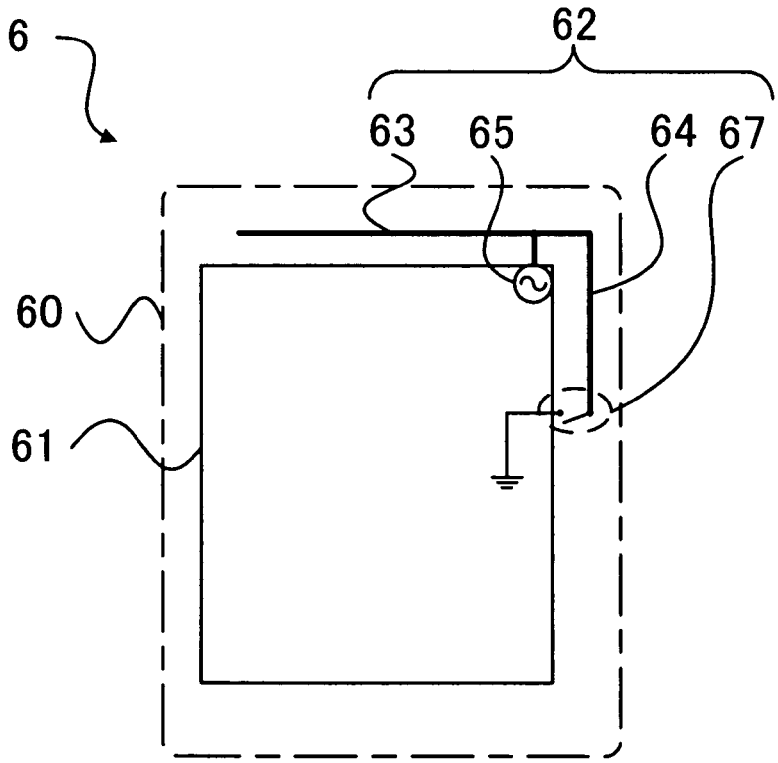
FIG. 22 shows a configuration of a radio apparatus and an antenna device of a fifth embodiment of the present invention.

A fifth embodiment of the present invention will be described with reference to FIGS. 22 to 24. FIG. 22 shows a configuration of a radio apparatus 6, including an antenna device, of the fifth embodiment. The radio apparatus 6 of the fifth embodiment has a case 60 indicated by a dot-and-dash line. The radio apparatus 6 has a printed board 61 and an antenna device 62 contained in the case 60.

The radio apparatus 6 may be, e.g., a mobile phone having the case 60. The radio apparatus 6 may have an extra case (not shown) connected to the case 60.

The antenna device 62 includes a first antenna element 63 and a second antenna element 64. The first antenna element 63 is arranged in parallel with a short side of the printed board 61. The second antenna element 64 is arranged in parallel with a long side of the printed board 61. The first antenna element 63 and the second antenna element 64 are fed in common at a feeding point 65 located on the printed board 61. The first antenna element 63 is located near an end of the printed board 61, and so is the second antenna element 64.

The antenna device 62 includes a switch element 67 having two terminals. One of the terminals is coupled to an end of the second antenna element 64. Another one of the terminals is coupled to a ground pattern of the printed board 61 and is thus grounded. Due to these couplings of the terminals of the switch element 67, the second antenna element 64 is grounded at the end to which the switch element 67 is coupled in one state (called a grounded state), and is not grounded in another state (called an ungrounded state).

Figure 23:
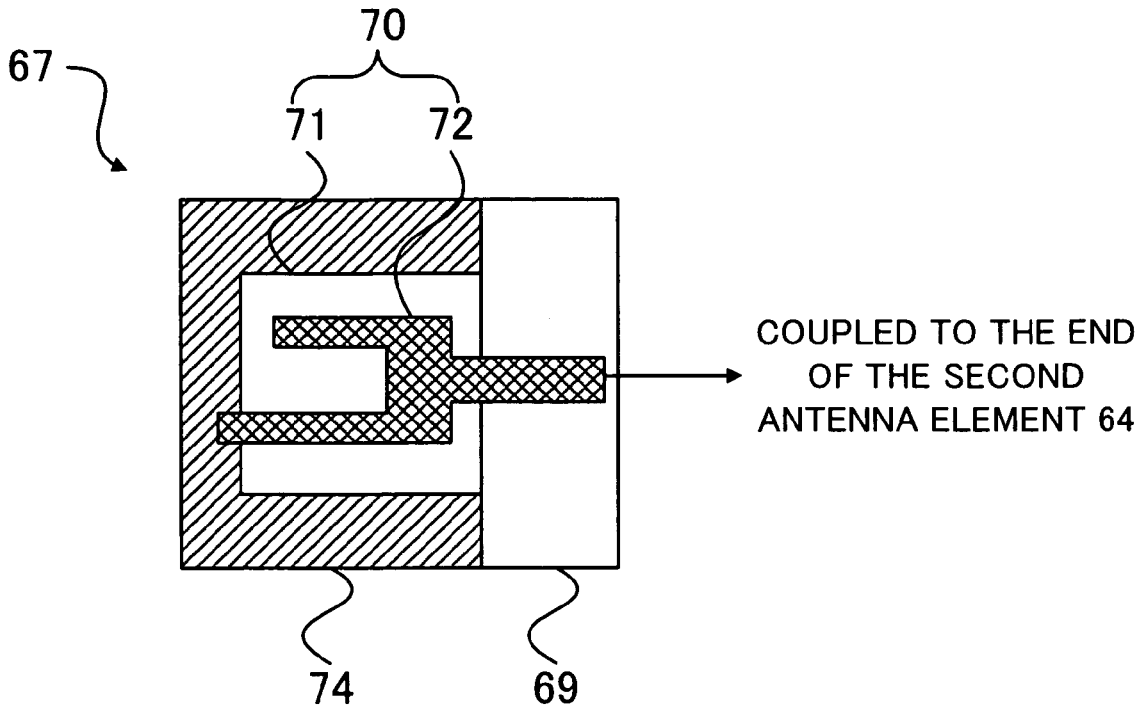
FIG. 23 shows a configuration of a switch included in the antenna device of the fifth embodiment.

FIG. 23 shows a configuration of the switch element 67. The switch element 67 includes a substrate 69 and a semiconductor switch 70. The semiconductor switch 70 is formed by, e.g., a metal semiconductor field effect transistor (MESFET) having a gate portion 71 and a source-drain portion 72.

The gate portion 71 is located on a ground pattern 74 of the substrate 69. To the gate portion 71, coupled is a control line (not shown) to turn on and off the switch element 67. The source-drain portion 72 has an electrode shown on a left lower side of FIG. 23 and coupled to the ground pattern 74. The source-drain portion 72 has another electrode shown on a right side of FIG. 23 and coupled to the end of the second antenna element 64.

A portion of the substrate 69 shown on a right side of FIG. 23 has no ground pattern. If that portion has a ground pattern, the end of the second antenna element 64 and the ground pattern are electrostatically coupled to each other so that it may become difficult that a resonant frequency is adjusted or input impedance is matched as designed in a case where the end of the second antenna element 64 is grounded.

Figure 24:
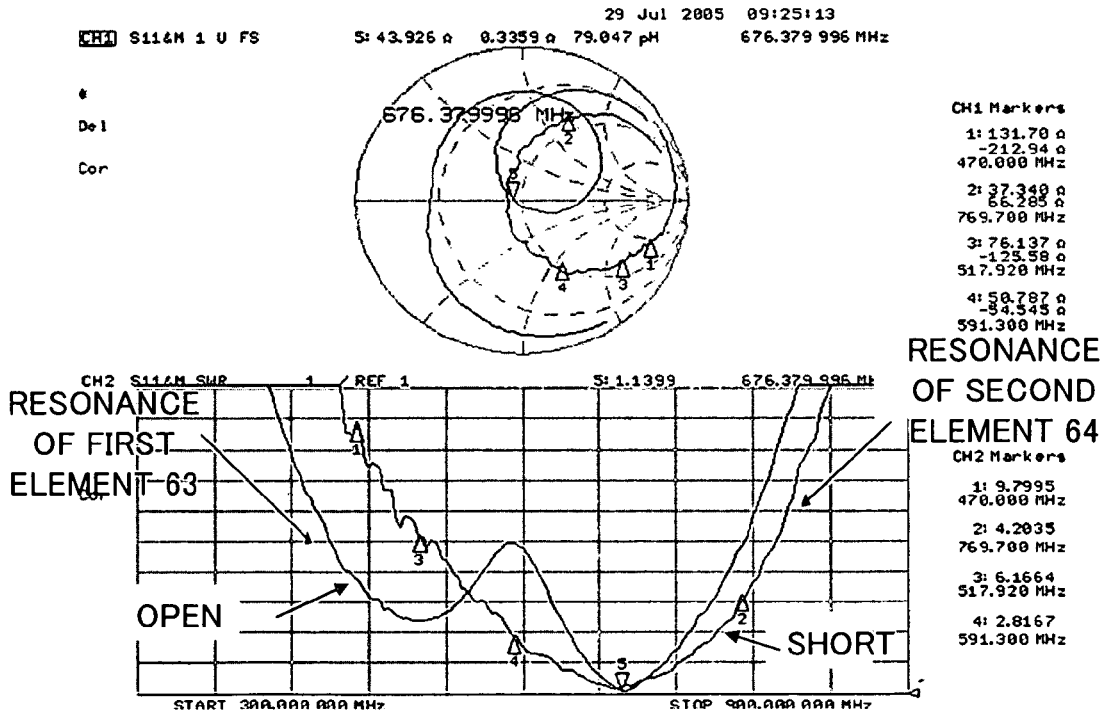
FIG. 24 shows a measured characteristic of the antenna device of the fifth embodiment.

FIG. 24 shows a characteristic of the antenna device 62 configured as shown in FIGS. 22 and 23, that is measured in an UHF band. FIG. 24 shows a Smith chart in an upper half thereof and a VSWR characteristic over a frequency range in a lower half thereof.

The VSWR characteristic includes a curve noted as "OPEN" measured while the switch element 67 is being open, and includes a curve noted as "SHORT" measured while the switch element 67 is being closed. The former curve shows two distinct resonances of the first antenna element 63 and the second antenna element 64. That indicates a same effect as that of the second embodiment as described with reference to FIG. 12.

According to the fifth embodiment described above, a switch is coupled to an antenna element at a location apart from a ground pattern of a printed board so that an effect of switching the antenna element between grounded and ungrounded may surely be obtained.

In the above embodiments, the switch elements 16 and 27 may be implemented as a mechanical switch, a semiconductor switch, etc.

The particular hardware or software implementation of the present invention may be varied while still remaining within the scope of the present invention. It is therefore to be understood that within the scope of the appended claims and their equivalents, the invention may be practiced otherwise than as specifically described herein.

What is claimed is:

1. An antenna device configured to be coupled to a feeding point of a radio apparatus, comprising:

a first antenna element configured to be an unbalanced-fed antenna being fed at the feeding point to resonate at a first frequency; and a second antenna element configured to be a monopole antenna having an open end and to be fed at the feeding point, the first antenna element and the second antenna element having a common portion from the feeding point to a branching point, the second antenna element configured to be ungrounded in a first state to resonate at a second frequency lower than the first frequency and to be grounded in a second state at a switch point between the branching point and the open end.

2. The antenna device of claim 1, further comprising a switch element located at the switch point and included in the second antenna element, the switch element configured to switch the second antenna element between the first state and the second state.

3. The antenna device of claim 1, further comprising a switch element located at the switch point and included in the second antenna element, the switch element configured to switch the second antenna element between the first state and the second state, two portions of the second antenna element on both sides of the switch point coupled to each other by the switch element in the first state, and the two portions uncoupled to each other by the switch element in the second state.

4. The antenna device of claim 1, further comprising a switch element located at the switch point and included in the second antenna element, the switch element configured to switch the second antenna element between the first state and the second state, two portions of the second antenna element on both sides of the switch point coupled to each other by the switch element in the first state, and one of the two portions coupled to the feeding point is grounded via the switch element to the radio apparatus in the second state.

5. The antenna device of claim 1, further comprising a switch element located at the switch point and included in the second antenna element, the switch element configured to switch the second antenna element between the first state and the second state, and a summed length of two portions of the second antenna element on both sides of the switch point is greater than a quarter wavelength of the first frequency.

6. The antenna device of claim 1, further comprising a switch element having two terminals, one of the two terminals coupled to the switch point, and another one of the two terminals grounded to the radio apparatus.

7. The antenna device of claim 1, further comprising a switch element having two terminals, one of the two terminals coupled to the switch point, another one of the two terminals grounded to the radio apparatus, and a portion of the second antenna element between the switch point and the open end having a length less than a quarter wavelength of the first frequency.

8. The antenna device of claim 1, further comprising a switch element having two terminals, one of the two terminals coupled to the switch point, another one of the two terminals grounded to the radio apparatus, wherein the switch point coincides with the open end.

9. The antenna device of claim 1, further comprising a reactance element loaded between the switch point and the open end.

10. The antenna device of claim 1, further comprising a reactance element, wherein the second antenna element is grounded through the reactance element to the radio apparatus in the second state.

11. A radio apparatus, comprising:

a case;

a printed board contained in the case, the printed board including a feeding point and a ground pattern thereof; and an antenna device contained in the case, the antenna device including a first antenna element and a second antenna element, the first antenna element configured to be an unbalanced-fed antenna being fed at the feeding point to resonate at a first frequency, the second antenna element being a monopole antenna having an open end and to be fed at the feeding point, the first antenna element and the second antenna element having a common portion from the feeding point to a branching point, the second antenna element configured to be ungrounded in a first state to resonate at a second frequency lower than the first frequency and to be grounded in a second state at a switch point between the branching point and the open end.

12. The radio apparatus of claim 11, further comprising an extra case connected to the case by a connection, an extra printed board contained in the extra case, the extra printed board including a ground pattern thereof, and a coupling member coupling the extra printed board to the printed board through the connection, wherein the coupling member couples a portion of the printed board to a portion of the extra printed board so as to extend a length of a return current path formed by the ground pattern of the printed board, the coupling member and the ground pattern of the extra printed board.

* * * * *